United States Patent [19]

Healy

[11] 4,336,830

[45] Jun. 29, 1982

[54] VAPOR RECOVERY JET PUMP

[76] Inventor: James W. Healy, 54 Plymouth Rd., Wakefield, Mass. 01880

[21] Appl. No.: 144,249

[22] Filed: Apr. 28, 1980

[51] Int. Cl.[3] ..... B65B 3/18; B65B 57/14

[52] U.S. Cl. ..... 141/59; 137/202; 141/206; 141/301

[58] Field of Search ..... 137/202; 141/42, 46, 141/59, 206, 285, 290, 301, 302, 303, 392; 417/182.5

[56] References Cited

U.S. PATENT DOCUMENTS 3,996,977 12/1976 Hansel ..... 141/392 X 4,062,384 12/1977 Frahm et al. ..... 141/290 X 4,095,626 6/1978 Healey ..... 141/206

*Primary Examiner*—Frederick R. Schmidt

*Attorney, Agent, or Firm*—W. R. Hulbert

[57] ABSTRACT

A liquid jet gas pump providing suction to recover vapor through a line connected to dispensing nozzle, the pump having chambers for collecting liquid carried by returning vapor and a float therein so that the float, when the amount of liquid collected in the chambers becomes too great, blocks the suction path through the pump thereby shutting off the dispensing nozzle. The pump also has an internal connection from a diaphragm chamber to an internal area which is substantially at atmospheric pressure during pump operation thereby eliminating the need for an access vent from the diaphragm chamber to the atmosphere.

8 Claims, 5 Drawing Figures

VAPOR RECOVERY JET PUMP

FIELD OF THE INVENTION

This invention relates to an improvement in the vapor recovery system for service station dispensing units covered by my U.S. Pat. No. 4,095,626, particularly in regard to the liquid jet gas pump of that invention.

BACKGROUND OF THE INVENTION

The background relating to vapor recovery systems is fully set forth in my U.S. Pat. No. 4,095,626, hereby incorporated by reference.

Briefly, in filling a vehicle's fuel tank at a service station, hydrocarbon vapors are displaced from the tank, and it is desirable to return these vapors to the underground fuel reservoir rather than discharge them into the atmosphere. My invention as disclosed in the aforementioned U.S. patent, accomplishes this by using a liquid jet gas pump. This pump employs a fuel flow therethrough to create a vacuum which draws the displaced vapors from a dispensing nozzle through a return conduit within the fuel hose back to the underground reservoir. However, in order to prevent vapor line blockage, the suction must be strong enough so that the vapors also entrain and carry along any liquid in the return line. It is extremely desirable that this returning liquid be detected, and if present in a sufficient amount, indicating too much suction, the dispensing nozzle automatically shuts off. For easy installation, it is also desirable that the liquid jet gas pump not require an external connection the atmosphere.

SUMMARY OF THE INVENTION

It is a principal object of this invention to provide a liquid jet gas pump for a vapor recovery system, which pump detects liquid in the vapor flow and shuts off the dispensing nozzle if too much liquid is detected. It is also an object of this invention to provide a liquid jet gas pump which does not need an external connection to atmosphere.

In accordance with the invention there is provided for use in a vapor recovery system for a fuel dispensing system, wherein fuel is pumped from a reservoir to a dispensing nozzle under pressure for filling a container, vapor from the container is returned to the reservoir through a vapor return line associated with the nozzle, the nozzle having means for shutting off the flow of fuel therethrough responsive to predetermined back pressure in the return line, and vapor return being actuated by vacuum produced by a liquid jet gas pump powered by jetting a fraction of the output of the fuel pump through a tube wherein it mixes with and entrains the returning vapor and carries it back to the reservoir, the following improvement in the liquid jet gas pump enabling it to temporarily store and then discharge into the reservoir accumulated liquid carried into the pump with vapor in the return line. The improvement comprises means providing a surge chamber within the pump through which the vapor is drawn, liquid collecting means upstream of the surge chamber, and means for blocking flow through the surge chamber when the liquid in the collecting means reaches a predetermined level.

In preferred embodiments, the liquid jet gas pump includes a pair of interconnected chambers which are in fluid communication with the vapor return line. As the chambers are larger in cross-section area than the return line, vapor velocity in the chambers is less than that of the return line, and any fuel carried by the vapor drops out into the chambers. One chamber contains a float which, if the liquid level in the chamber rises enough, blocks the vacuum path back to the underground reservoir. Vapor can no longer escape from the vehicle tank through the jet pump, and pressure in the tank rises causing the nozzle, which senses the pressure rise, to shut off. In addition, a diaphragm chamber of the pump is connected by a passageway to space between the discharge tube from the pump and its surrounding casing, which space is at a pressure close to atmospheric during pump operation.

DESCRIPTION OF THE DRAWINGS

Other objects, features, and advantages of the invention will be apparent to those skilled in the art from the following description of the preferred embodiment taken together with the accompanying drawings, in which.

DESCRIPTION OF THE PREFERRED EMBODIMENT

Figure 1:
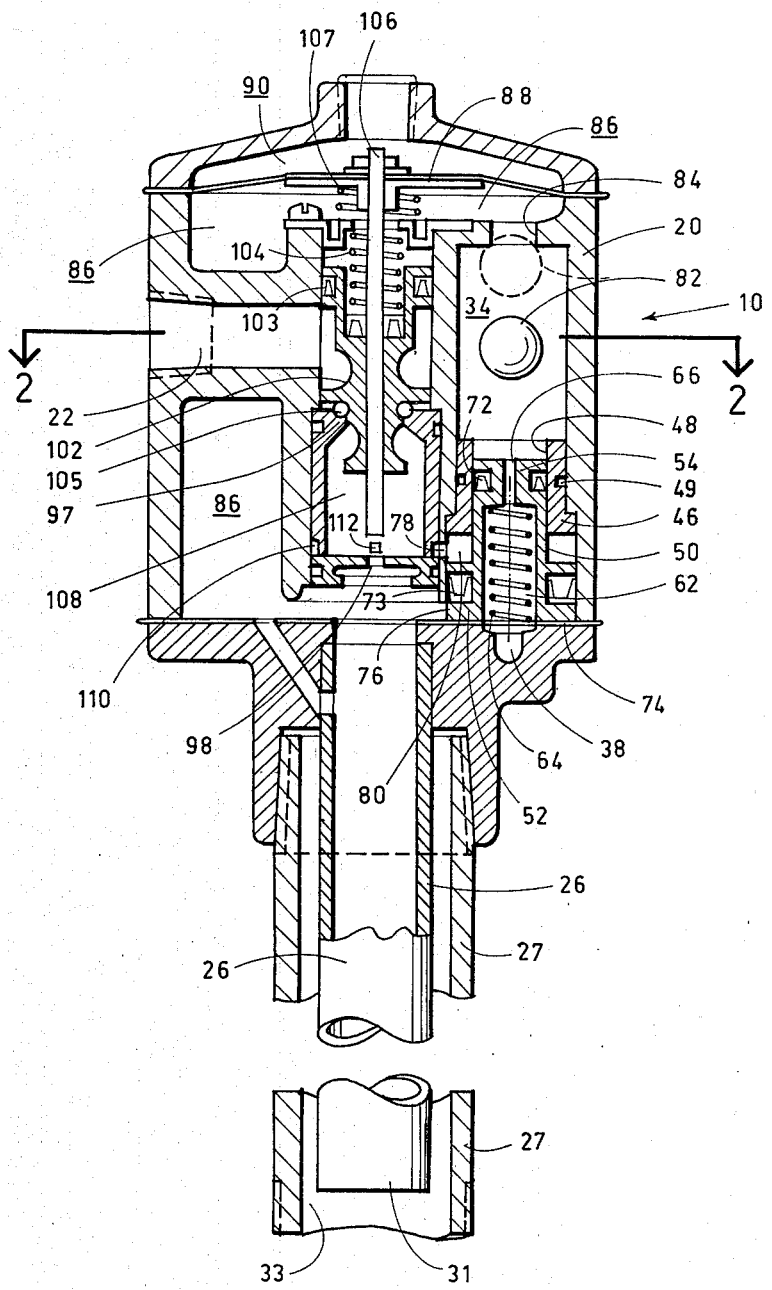
FIG. 1 is a vertical sectional view of a liquid jet gas pump embodying this invention taken on line 1—1 of FIG. 2.
Figure 5:
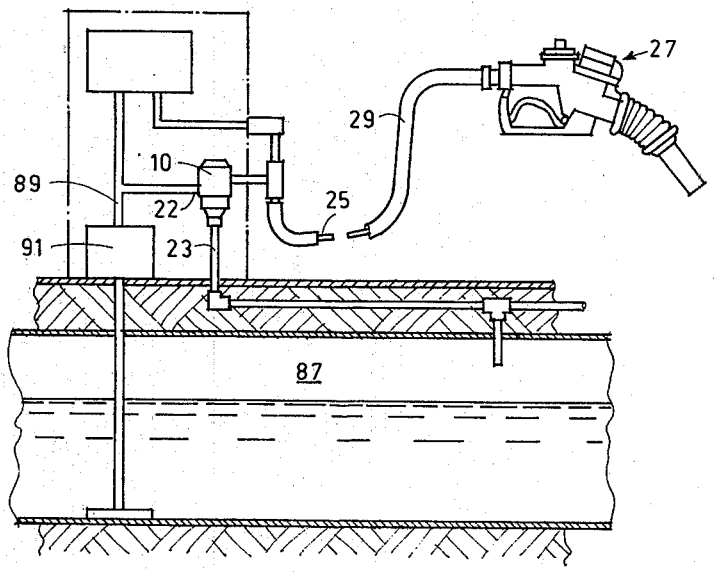
FIG. 5 is a largely diagrammatic representation of a gasoline filling station installation employing the pump of the invention.

Referring first to FIGS. 1 and 5, a liquid jet gas pump for a vapor recovery system is designated generally by the numeral 10. Pump 10 includes a housing 20 having a gasoline inlet 22, a vapor return input 24, and an output mixing tube 26 which terminates at 31 in space 33 in casing 27 which, in turn, empties into reservoir 87.

Figure 2:
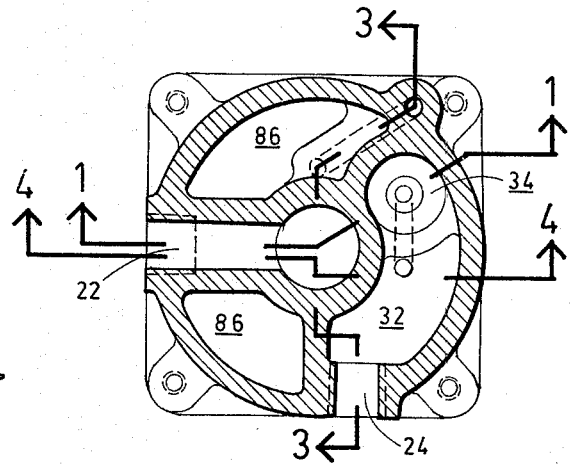
FIG. 2 is a cross-sectional view on a slightly smaller scale taken on line 2—2 of FIG. 1 with the internal mechanisms removed.
Figure 4:
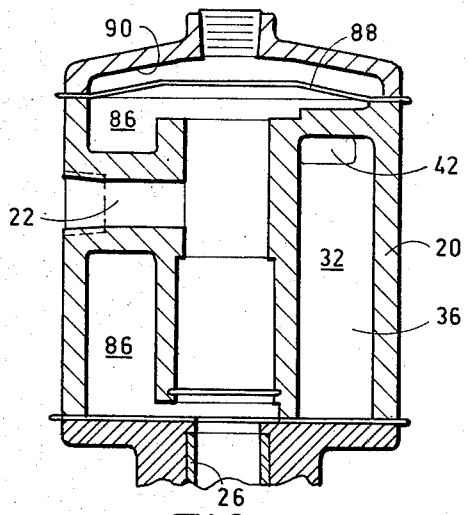
FIG. 4 is a similar view taken along line 4—4 of FIG. 2.

As best seen in FIG. 2, the vapor return input 24, connected by a line 25 (FIG. 5) within hose 29 to a dispensing nozzle 27, communicates with a first chamber 32 inside the housing 20. The nozzle 27 is of a type, known per se, which automatically shuts off the flow of fuel if the pressure in the vapor return line reaches a predetermined level. The first chamber 32 is adjacent to a cylindrical piston chamber 34 and separated therefrom by a common wall 36. The two chambers 32, 34 are in fluid communication through a lower passageway 38 beneath the wall 36 (FIGS. 1 and 2) and an opening 42 (FIG. 4) in the top of wall 36.

As best seen in FIG. 1, a sleeve 46 having a central bore 48 is disposed inside the piston chamber 34 above its bottom. O-ring 49 seals the sleeve 46 to the sidewall of the chamber 34. A piston 50, having an enlarged piston head 52 and a cylindrical end piece 54, is positioned inside the chamber 34 so that the enlarged piston head 52 is below the sleeve 46 and the cylindrical end piece 54 is disposed in the sleeve bore 48. Piston 50 has a hollow cylindrical chamber 62 extending partially therethrough wherein spring 64 is disposed to bias the piston 50 upwardly. A narrow channel 66 extends from chamber 62 through the remaining portion of the piston 50 establishing communication with cylinder 34. U-cup 72 provides a sliding seal between the cylindrical end piece 54 of the piston 50 and the sleeve 46, and U-cup 73 provides a seal between the piston head 52 and the sidewall of the cylindrical chamber 34.

A portion of the lower face of the piston head 52 rests on and is sealed against a gasket 74 when the piston is in its lowest position, as in FIG. 1. At the same time, the side of the piston head 52 seals a drain opening 76 in the sidewall of the cylindrical chamber 34 while an access opening 78 communicates with a space 80 between the piston head 52 and the sleeve 46. In addition, regardless of the position of the piston 50, there is a flow path from the lower passageway 38 through the spring chamber 62 and the channel 66 in the piston 50 to the upper portion of the piston chamber 34.

Figure 3:
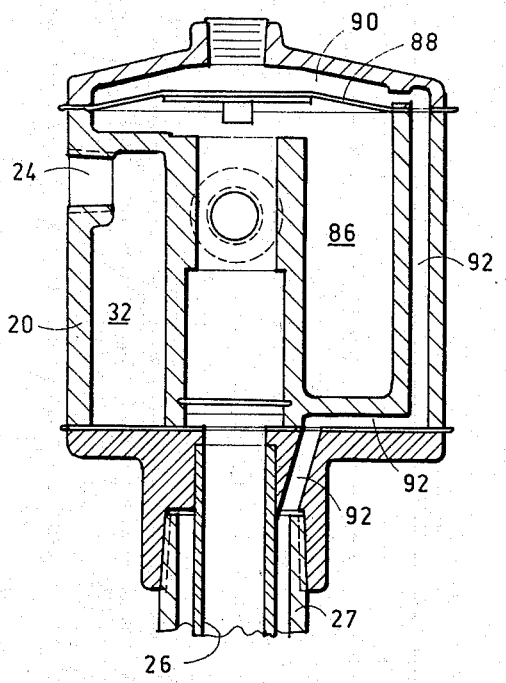
FIG. 3 is a similar view taken along line 3—3 of FIG. 2.

A hollow plastic ball 82 (shown in full lines suspended and in broken lines in its uppermost position blocking opening 84 in FIG. 1), with a specific gravity less than that of the fuel, is located above the piston 50 in the piston chamber 34. Chamber 34 has a port 84 centrally disposed in its top, which port 84 communicates with a surge chamber 86 downstream of chambers 32 and 34. The lower part of surge chamber 86 communicates with the drain opening 76 in the side of the piston chamber 34 and also with the output mixing tube 26 which goes to the underground storage tank 87. The top of the surge chamber 86 is bounded by a diaphragm 88. A chamber 90 above the diaphragm 88 is connected to passageway 92 (FIG. 3). The opposite end of the passageway 92 discharges into the top of the space between mixing tube 26 and a surrounding casing 27.

Inlet 22, which is connected to the gasoline output line 89 from the pump 91 (FIG. 5), communicates through valve seat opening 97 with jet orifice 98 and the lower part of the surge chamber 86. Pilot valve 102, having U-cup 103 and O-ring 105 as seals, is spring-biased downwardly by spring 104. Needle rod 106 passes through the valve 102, and the top of rod 106 is connected to the diaphragm 88. The diaphragm 88 is spring-biased upwardly by spring 107. A large valve chamber 108 is disposed between the valve seat opening 97 and the jet orifice 98. The outer sidewall of the chamber 108 has an annular passage 110 which communicates with the access hole 78 in the side of piston chamber 34. An opening 112 provides a fluid connection between the passage 110 and the inside of valve chamber 108.

Operation

The basic operation of the jet pump 10 is as described in my said U.S. Pat. No. 4,095,626. Briefly, as fuel pump 91 sends gasoline from an underground reservoir 87 to a dispensing nozzle 27 (parts not shown), a portion of the pumped gasoline flows into jet pump 10 through gasoline conduit 89 into inlet 22 and the pressure on the pilot valve 102 rises. Because the U-cup 103 for the pilot valve 102 has a greater area than the O-ring 105, the resultant force on valve 102 is upward and the valve is forced upwardly, and the gasoline flows through the jet orifice 98 and down into the mixing tube 26. This draws vapor from the dispensing nozzle 27 through the vapor return line 25 to opening 24 into chambers 32 and 34 and finally through port 84 into surge chamber 86. The vapor velocity is sufficient to carry along any liquid in the return line.

In this invention, the flow area of the chambers 32, 34 are large compared to the flow area of the return line 25 and the input 24. Therefore, as vapor velocity is inversely proportional to the flow area, the velocity drops as the vapor proceeds into the chambers 32, 34. At the reduced velocity, any liquid gasoline carried along by the vapor flow then tends to coalesce into droplets and fall out of the flow. This liquid is collected in the bottom of chamber 32 and also in the bottom of chamber 34. Relative levels in both chambers 32, 34 are the same because the lower passageway 38 connects them. During normal operation, the liquid in piston chamber 34 cannot drain out of drain opening 76 because the piston 50 is held in its lowest position, shown in FIG. 1, due to the pressure of the gasoline in valve chamber 108, which chamber 108 is in fluid communication through access hole 78, annular passage 110 and opening 112 with the space 80 between the piston head 52 and the sleeve 46.

As more and more liquid collects in chamber 34, the float ball 82 rises within chamber 34. If the liquid level rises sufficiently, the ball will block port 84, thereby preventing any further vapor flow through the surge chamber 86. The vapor pressure will rise in vapor return line 25, and the nozzle 27, sensing the pressure rise, will shut off. Therefore, when too much liquid is collected, the entire system is shut down by the jet pump 10.

In order to restart the pumping operation, the gasoline pressure source, fuel pump 91, must be shut off for 5 to 10 seconds. The gasoline pressure in the valve chamber 108, therefore falls, and when it drops to 5 psi, piston 50 moves upwardly. Any gasoline trapped in the space 80 between the piston head 52 and the sleeve 46 is forced back into the valve chamber 108. From there, it drains through the jet orifice 98 into the mixing tube 26 and back to the storage tank. Any gasoline in chamber 34 above the level of end piece 54 flows through channel 66 in the piston 50, out the now-exposed drain opening 76, and similarly down the mixing tube 26. Also, any gasoline in chamber 32 flows through lower passageway 38 into chamber 34 and out the drain opening 76. The pump can then be restarted and the parts returned to normal position.

The chamber 90 above the diaphragm 88 is essentially at atmospheric pressure because the pressure at the space 33 between the outlet of the mixing tube 26 and its casing 27, with which it is in communication, is within $\pm 1$ inch $H_2O$ of atmospheric pressure when pump 10 is in operation. Therefore, it is not necessary for chamber 90 to be vented to the atmosphere. The operation of the diaphragm 88 and the chamber 90 is the same as with the jet pump of my U.S. Pat. No. 4,095,626.

Other variations will occur to those skilled in the art.

What is claimed is:

1. For use in a vapor recovery system for a fuel dispensing system wherein fuel is pumped from a reservoir to a dispensing nozzle under pressure for filling a container, vapor from the container is returned to the reservoir through a vapor return line associated with the nozzle, the nozzle having means for shutting off the flow of fuel therethrough responsive to predetermined back pressure in said return line, and wherein the vapor return is actuated by vacuum produced by a liquid jet gas pump powered by jetting a fraction of the output of a fuel pump through a tube wherein it mixes with and entrains the returning vapor and carries it back to the reservoir, the improvement in said liquid jet gas pump enabling it to temporarily store, and then discharge into said reservoir, accumulated liquid carried into the pump with vapor in said return line, which comprises means providing a surge chamber within said pump through which said vapor is drawn, liquid collecting means upstream of said surge chamber to collect said liquid carried with said vapor in said return line, and means for blocking flow through said surge chamber and for building up said back pressure in said return line when the liquid in said collecting means reaches a predetermined level, whereby said means in said nozzle for shutting off the flow of fuel is actuated when said liquid in said collecting means reaches said predetermined level.

2. The improved liquid jet gas pump of claim 1 wherein said liquid collecting means comprises a liquid collecting chamber, said liquid collecting chamber having a port in its top, said port communicating with said surge chamber.

3. The improved liquid jet gas pump of claim 2 wherein said blocking means comprises a float ball with a specific gravity less than the collected liquid, said float ball being disposed inside said liquid collecting chamber so that said ball blocks said port when the level of the collected liquid in said chamber rises to a predetermined level.

4. The improved liquid jet gas pump of claim 2 wherein said liquid collecting means further comprises a piston chamber having a drain opening near its bottom, said drain opening being sealed by a piston head when liquid flows through said pump above a predetermined pressure.

5. The improved liquid jet gas pump of claim 4 wherein the predetermined pressure is 5 psi.

6. The improved liquid jet gas pump of claim 1 provided with a diaphragm separating an upper chamber from said surge chamber, a device actuated by movement of said diaphragm for shutting off the jetted fraction of the output of said fuel pump and means establishing communication between said upper chamber and a space above the liquid level in said reservoir whereby said upper chamber is maintained at substantially atmospheric pressure.

7. For use in a vapor recovery system for a fuel dispensing system wherein fuel is pumped from a reservoir to a dispensing nozzle under pressure for filling a container, vapor from the container is returned to the reservoir through a vapor return line associated with the nozzle, the nozzle having means for shutting off the flow of fuel therethrough responsive to predetermined back pressure in said return line, and wherein the vapor return is actuated by vacuum produced by a liquid jet gas pump powered by jetting a fraction of the output of a fuel pump, through a tube wherein it mixes with and entrains the returning vapor and carries it back to the reservoir, the improvement in said liquid jet gas pump enabling it to temporarily store, and then discharge into said reservoir, accumulated liquid carried into the pump with vapor in said return line, which comprises means providing a surge chamber within said pump through which said vapor is drawn, liquid collecting means upstream of said surge chamber and in fluid communication therewith, and means for blocking flow through said surge chamber when the liquid in said collecting means reaches a predetermined level, said liquid collecting means comprising a piston chamber, said piston chamber having a drain opening near its bottom, said drain opening being sealed by a piston head when liquid flows through said pump above a predetermined pressure, said liquid collecting means also comprising a first liquid chamber in fluid communication with said return line, said first chamber having a common sidewall with said piston chamber, said sidewall having a lower passageway beneath it so that said first chamber is in fluid communication with said piston chamber through said lower passageway.

8. In a liquid jet gas pump for a vapor recovery system having a diaphragm separating an upper chamber from a surge chamber, a preselected pressure difference between said upper chamber and said surge chamber forcing a pin connected to said diaphragm into an orifice thereby blocking liquid flow through said pump to an outlet tube, the improvement comprising:

a casing section coaxially surrounding but spaced from said outlet tube, and a conduit connecting said upper chamber to the area between said casing and said outlet tube, which area, though not vented directly to the atmosphere, is at approximately atmospheric pressure during pump operation.

* * * * *